US006378919B1

(12) United States Patent
Kitchen

(10) Patent No.: US 6,378,919 B1
(45) Date of Patent: Apr. 30, 2002

(54) CYLINDRICAL LOCK WITH SLAM LATCH AND AUXILIARY CABLE RELEASE

(75) Inventor: James M. Kitchen, Roankoe, IN (US)

(73) Assignee: International Truck Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/542,185

(22) Filed: Apr. 4, 2000

(51) Int. Cl.[7] ..... E05C 1/12
(52) U.S. Cl. ..... 292/171; 292/DIG. 43
(58) Field of Search ..... 70/465; 292/31, 292/41, 38, 141, 146, 166, 171, 174, DIG. 5, DIG. 42, DIG. 43

(56) References Cited

U.S. PATENT DOCUMENTS 2,563,317 A * 8/1951 Dix et al. ..... 292/171
2,616,739 A * 11/1952 Allen ..... 292/171
2,734,764 A * 2/1956 Angelo ..... 292/333
3,992,909 A * 11/1976 McGhee ..... 70/379 R
4,121,684 A * 10/1978 Stephens et al. ..... 180/89.14
4,225,166 A * 9/1980 Tanaka et al. ..... 292/341.17
4,351,554 A * 9/1982 Miller ..... 296/24.1
4,974,885 A * 12/1990 Yokoyama ..... 292/201
5,171,048 A * 12/1992 Weinerman et al. ..... 292/45
5,445,326 A * 8/1995 Ferro et al. ..... 292/336
6,135,514 A * 10/2000 Kowalewski et al. ..... 292/216
6,276,748 B1 * 8/2001 Gobessi et al.

* cited by examiner

*Primary Examiner*—Anthony Knight
*Assistant Examiner*—Vishal Patel
(74) *Attorney, Agent, or Firm*—Jeffrey P. Calfa; Neil T. Powell; Dennis Kelly Sullivan

(57) ABSTRACT

The invention provides a dual release system for a slam lock to a luggage compartment door for a vehicle. The slam lock, as is conventional, includes a catch and a latch bar. The catch is installed on a surface of the luggage compartment adjacent the door. The latch bar is mounted through a lock cylinder, which is in turn mounted through opposite major sides of the door to bring the latch bar into engagement with the catch when the door is closed. The latch bar is spring biased to releasably engage the catch. The lock cylinder is accessible by key from the major side of the door on the exterior of the vehicle, and is actuable to move the latch bar to a released position relative to the catch. A release cable within the vehicle is attached to the latch bar to pull the latch bar to the released position relative to the catch.

2 Claims, 5 Drawing Sheets

CYLINDRICAL LOCK WITH SLAM LATCH AND AUXILIARY CABLE RELEASE

BACKGROUND OF THE INVENTION

1. Field of the Invention

The present invention relates to locks for sleeper cab units installed on trucks.

2. Description of the Prior Art

Tractor rigs for trucks used for long distance hauling of trailers often have a sleeping unit for the driver or his relief. The sleeping units are usually attached to the back of the tractor cab as a sleeping cab or are formed as an integral rearward extension of the tractor cab itself.

In order to conveniently exploit all of the usable space of the sleeping unit, portions of the sleeping unit not readily used as living space may be used as space for luggage. Access to this space as luggage compartments may be had from the exterior of the sleeping unit through luggage doors.

The luggage door or doors have typically been secured by the use of slam locks. The slam locks secure the doors from opening unless the slam lock is released. The release mechanism for these slam locks has typically been an internal mechanical system connected to a handle accessible from one of the seats in the driver compartment or a key release system accessible only from the exterior of the vehicle. No system has provided the convenience of both internal and external operation as has been provided with automobile trunks for many years. This may stem in part from the differences between slam locks and the latching mechanisms used for automotive trunks.

Many users would prefer to be able to gain access to the luggage compartment both directly from outside the passenger cab as well as being able to internally release the latch for the luggage compartment.

SUMMARY OF THE INVENTION

An object of the invention is to provide an auxiliary door for a vehicle, the door having two release systems, one being accessible from inside the vehicle and the other being accessible from outside the vehicle.

The invention provides a dual release system for a slam lock to a luggage compartment door for a vehicle. The slam lock, as is conventional includes a catch and a latch bar. The catch is installed on a surface of the luggage compartment adjacent the door. The latch bar is mounted through a lock cylinder, which is in turn mounted through opposite major sides of the door to bring the latch bar into engagement with the catch when the door is closed. The latch bar is spring biased to releasably engage the catch. The lock cylinder is accessible by key from the major side of the door on the exterior of the vehicle, and is actuable to move the latch bar to a released position relative to the catch. A release cable or similar mechanism within the vehicle is attached to the latch bar to pull the latch bar to the released position relative to the catch and thereby release the slam lock.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
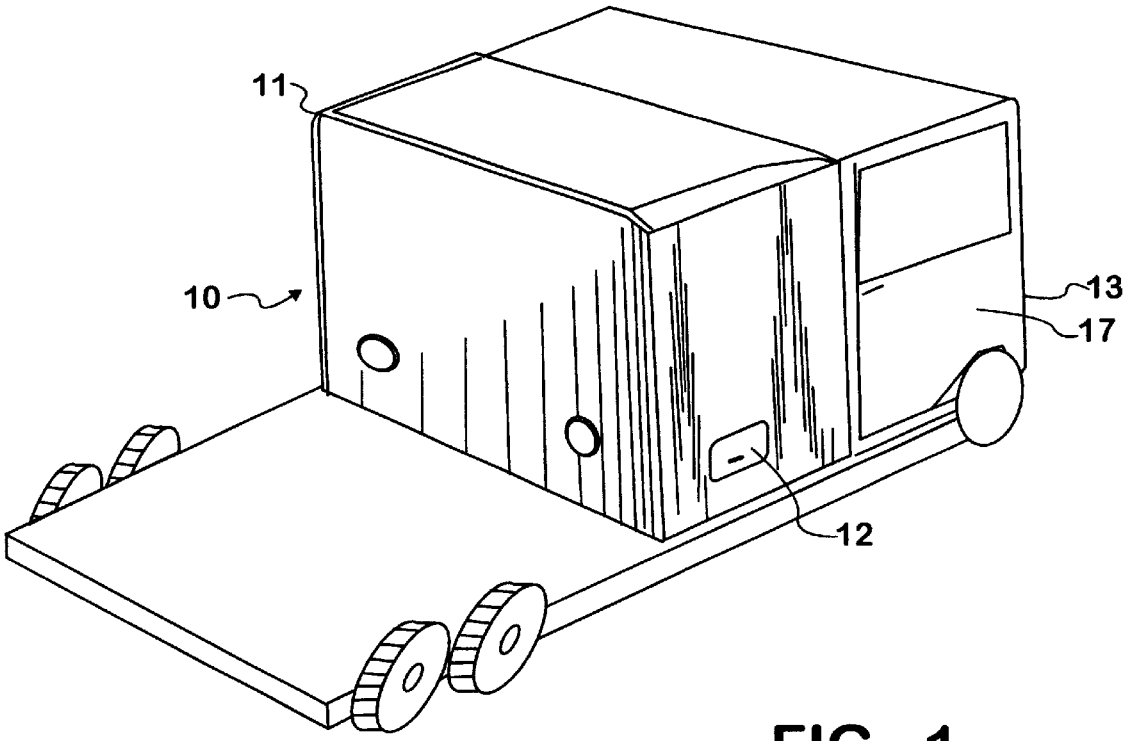
FIG. 1 is a perspective view of a tractor sleeper cab showing an auxiliary access door.

FIG. 1 is a perspective view of a truck tractor unit 10 on which is mounted a sleeper cab 11. In the figures like numerals refer to equivalent structures. An auxiliary door 12 into sleeper cab 11 provides access to luggage or auxiliary equipment stored in a compartment (not shown) in the sleeper cab. Tractor unit 10 also includes an operator cab 13 mounted forward from the sleeper cab 11 and through which access to the sleeper cab may be gained. Passenger and operator access to operator cab 13 is through doors on each side of the tractor unit 10 including right side door 17. Conventionally, a pull handle for releasing a slam lock securing auxiliary door 12 is located inside the operator cab 13 near door 17.

Figure 2:
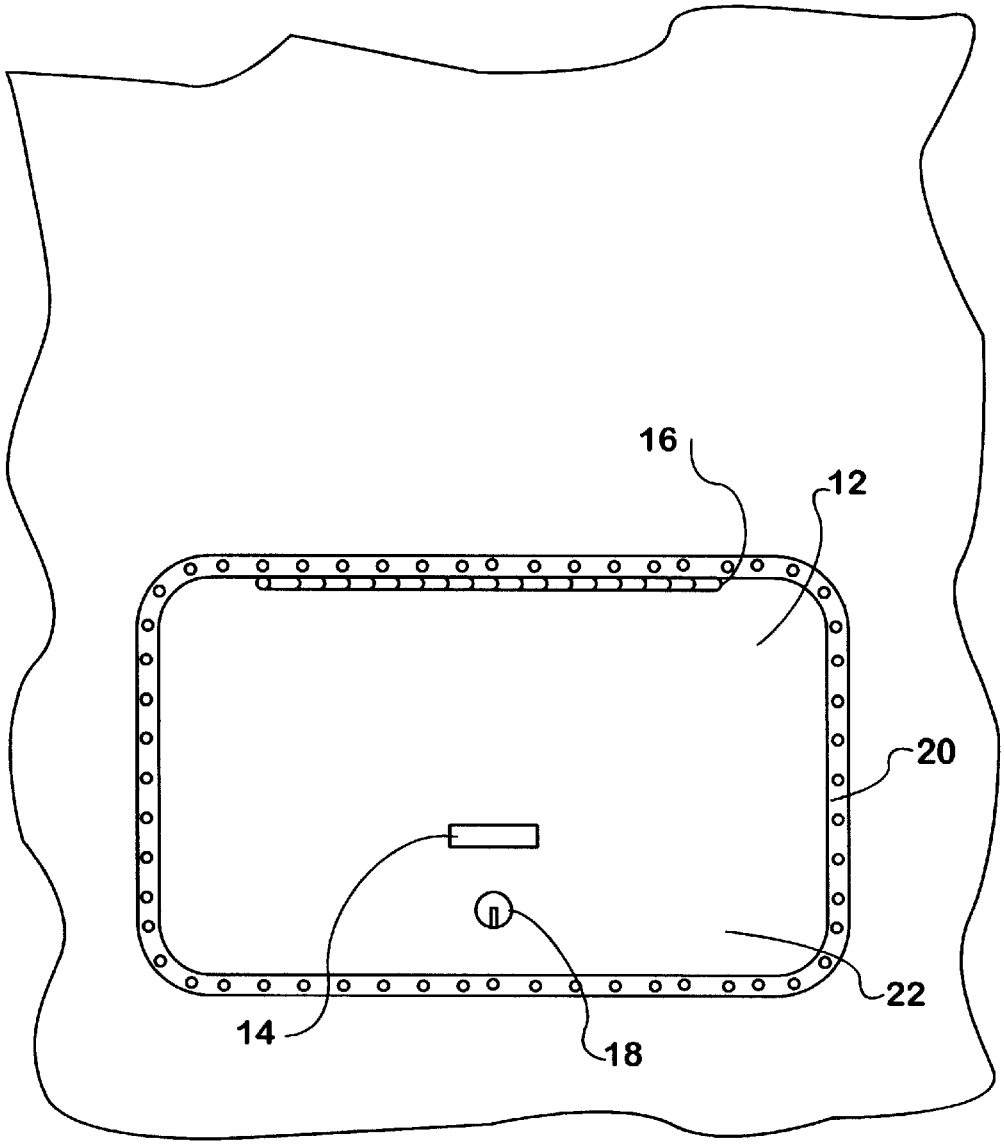
FIG. 2 is a side elevation of a tractor sleeper cab auxiliary access door.

FIG. 2 is an exterior view of auxiliary door 12. Auxiliary door 12 may be lifted open after release of an interior slam lock by pulling on handle 14. Auxiliary door 12 swings open on hinge 16, which couples the door to a rim 20 defining an access through the side of sleeper cab 11. The slam lock internally securing auxiliary door 12 may be released by rotation of a key introduced to key access 18 through exterior major face 22 of the auxiliary door.

Figure 3:
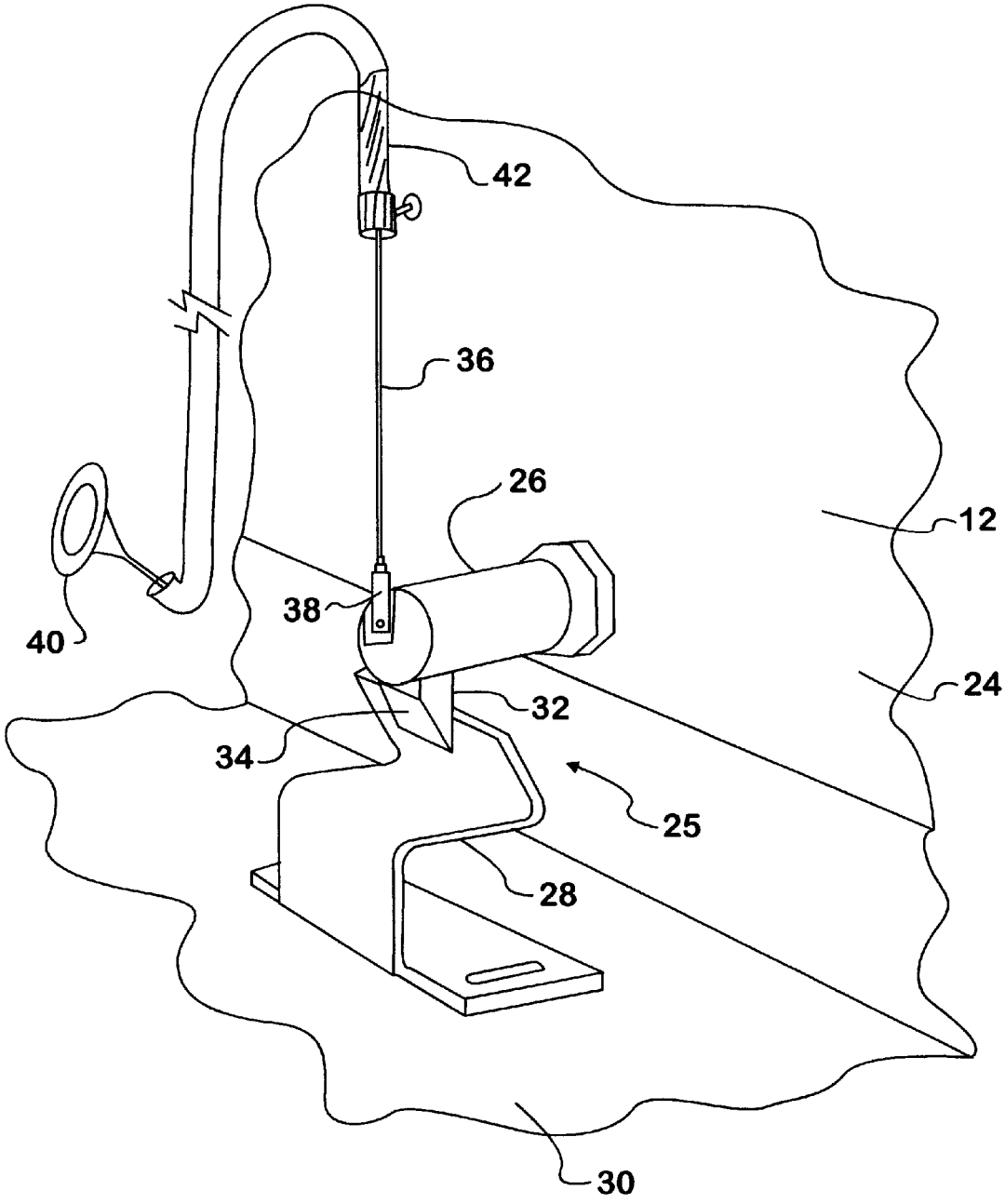
FIG. 3 is a perspective view of a cylindrical lock with slam latch and auxiliary cable release.

FIG. 3 is a perspective view of a slam lock 25 used to secure auxiliary door 12 in a closed position. Slam lock 25 includes a catch 28 mounted to a floor 30 of an internal storage or luggage compartment. Cylinder lock 26 is mounted through auxiliary door 12 and projects into the interior compartment from an internal major face 24 of the auxiliary door. Catch 28 is positioned to engage a latch bar 32 extending downwardly from cylinder lock 26 whenever auxiliary door 12 is closed. Latch bar 32 has beveled end 34 the leading surface of which rides over catch 28 as door 12 is forced closed. Latch bar 32 moves downwardly once it clears catch 28 to lock. Catch 28 is a rigid, single piece element, sloped along the face first contacting the approaching beveled end 34 in a direction to cooperate with urging latch bar 32 upwardly against a biasing spring (discussed below).

Latch bar 34 may be pulled upwardly to release the engagement of bar 32 from catch 28. One mechanism to effect release of slam lock 25 is handle 40, which is connected to one end of release cable 36. Pulling on handle 40 applies tension along release cable 36. The opposite end of cable 36 is attached to the end of latch bar 32 opposite the beveled end 34. Tension on cable 36 thus acts to retract latch bar 32 upwardly out of engagement with catch 28. Release cable 36 is positioned and protected in a channel 42, which allows the handle 40 to be conveniently positioned anywhere in the vehicle. Alternative mechanisms may be provided for pulling latch bar 32 up and out of engagement with catch 28. For example, a rod and lever mechanism could be used, or an electric switch which activated motor for pulling a trip wire or rod attached to pull latch bar 32 upwardly.

Figure 4:
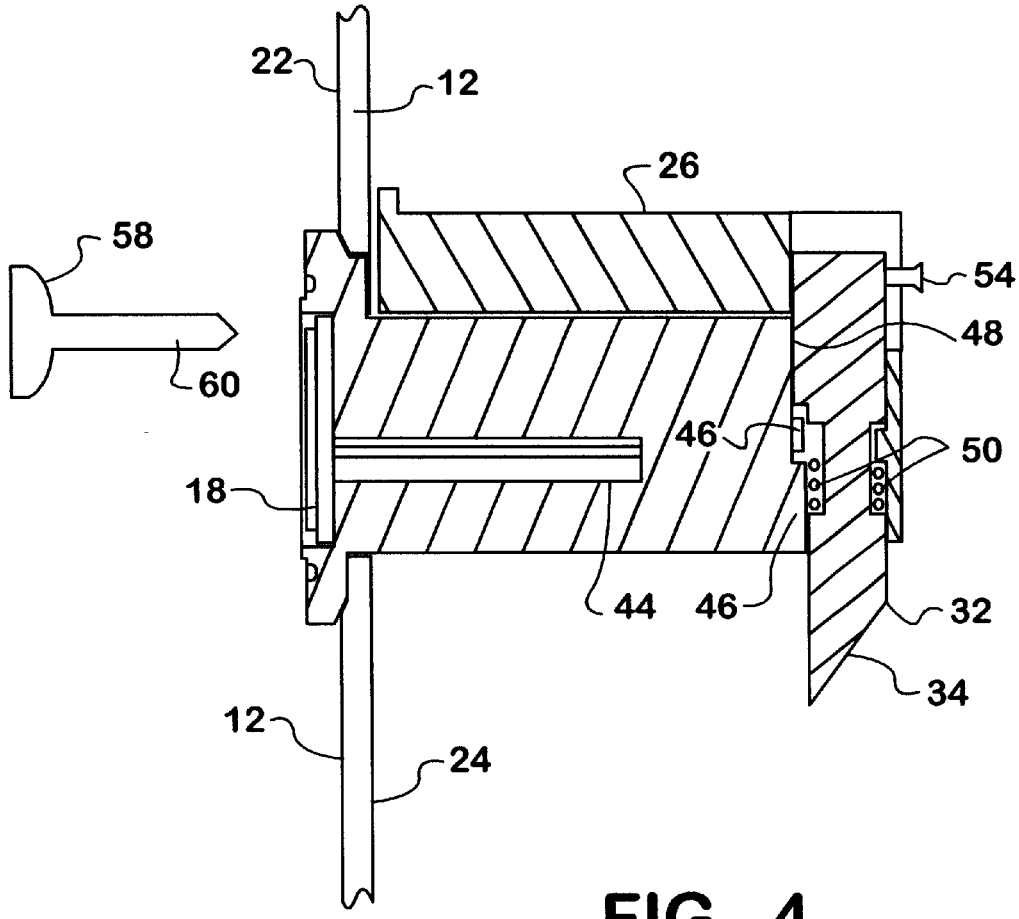
FIG. 4 is a perspective view of a cylindrical lock with slam latch.

FIG. 4 is a cross-sectional view of a cylinder lock 26. Latch bar 32 may also be retracted from engagement with catch 28 by rotation of the lock cylinder of cylinder lock 26. Cylinder lock 26 is mounted through auxiliary door 12 exhibiting a access 18 for a conventional key blade 60 to the exterior major face 22 of the door and extending beyond the interior major face 24 of the door. Upon insertion of key blade 60 of a key 58, lock cylinder 44 may be rotated to turn a cam 46, which in turn engages a cam rider 48 extending from latch bar 32 toward the main body of the lock cylinder 26. A compression spring 50 is disposed around the body of the latch bar 32 riding against cooperating surfaces extending from the bar or cylinder lock 26 to urge the latch bar downwardly. A peg 54 extends from latch bar 32 near its upper end to all attachment of release cable 36.

Figure 5:
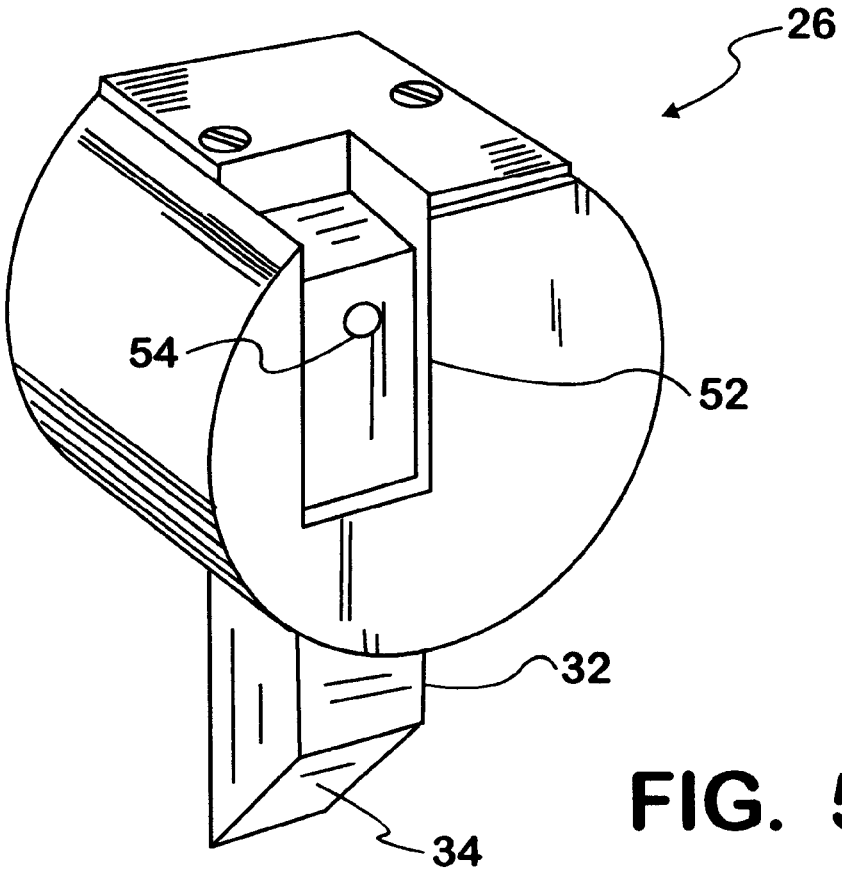
FIG. 5 is a cross-sectional view the cylindrical lock with slam latch.

FIG. 5 is a rear perspective view of cylinder lock 26 illustrating a notch 52 in the back of cylinder lock 26 to gain access to latch bar 32.

The invention provides a slam lock for securing an auxiliary door to a vehicle while giving users of the vehicle two release systems for the door. In the preferred embodiment a mechanical pull cable release system is accessible from inside the vehicle and a key actuated system is usable from outside the vehicle. The exterior key based release system for the slam lock luggage door may use the ignition key to the vehicle.

While the invention is shown in only one of its forms, it is not thus limited but is susceptible to various changes and modifications without departing from the spirit and scope of the invention.

What is claimed is:

1. Apparatus comprising:

a vehicle compartment;

a luggage compartment defined by a plurality of interior surfaces;

an access to the luggage compartment from a vehicle exterior;

a door hingedly attached along an edge of the access for closing the access;

a catch installed on a surface of the interior surface adjacent the access, the catch being a single piece rigid element having a fixed position in relation to the access and having a sloped face toward the access;

a lock cylinder mounted through opposite major sides of the door and defining a latch bar guide perpendicular to the lock cylinder;

a latch bar mounted in the latch bar guide for linear travel through the lock cylinder to releasably engage the catch, the latch bar being positioned by the latch bar guide to impinge on the catch as the door is closed and having a leading beveled edge along an exposed end of the latch bar for riding over the sloped face of the catch as the door is closed on the access;

a spring in the latch bar guide engaging the latch bar to bias the latch bar against the sloped face with the latch bar assuming an engaged position with the catch when the door is fully closed;

a cam mounted in the latch guide coupled to the lock cylinder and actuable by key from outside the luggage compartment when the door is closed to retract the latch bar to a released position relative to the catch;

a release cable attached to the latch bar at one end to retract the latch bar to the released position relative to the catch; and a handle attached to the opposite end of the release cable and positioned at a location remote to the latch bar and catch and outside the luggage compartment but inside the vehicle compartment.

2. Apparatus as claimed in claim 1, further comprising: the vehicle compartment is a truck sleeper unit.

* * * * *